United States Patent [19]

Wu

[11] Patent Number: 4,941,494

[45] Date of Patent: Jul. 17, 1990

[54] LIGHTLY-OPERATING AUTOMATIC UMBRELLA FOR PREVENTING FALSE OPERATION

[76] Inventor: Tsun-Zong Wu, No. 16, Chen Tai Rd., Sec. 3, Wu-Ku Hsiang, Taipei Hsien, Taiwan, 24801

[21] Appl. No.: 425,463

[22] Filed: Oct. 23, 1989

[51] Int. Cl.[5] ..... A45B 25/16

[52] U.S. Cl. ..... 135/20 M; 135/24; 135/28; 135/22

[58] Field of Search ..... 135/22, 24, 20 M, 28, 135/20 R, 23

[56] References Cited

U.S. PATENT DOCUMENTS

| | | | |
|---|---|---|---|
| Re. 24,477 | 5/1958 | Small | 135/20 M |
| 3,658,077 | 4/1972 | Sato | 135/22 |
| 3,672,381 | 6/1972 | Kida et al. | 135/22 |
| 3,732,881 | 5/1973 | Hirai | 135/22 |
| 4,421,133 | 12/1983 | Huang | 135/24 |
| 4,535,374 | 8/1985 | Day . | |
| 4,807,655 | 2/1989 | Robertson | 135/20 M X |
| 4,823,821 | 4/1989 | Day . | |
| 4,825,888 | 5/1989 | Su | 135/22 |

FOREIGN PATENT DOCUMENTS

| | | | |
|---|---|---|---|
| 973054 | 8/1975 | Canada | 135/20 M |
| 1939749 | 7/1970 | Fed. Rep. of Germany | 135/24 |
| 1934357 | 10/1970 | Fed. Rep. of Germany | 135/22 |
| 2353967 | 5/1974 | Fed. Rep. of Germany | 135/20 M |
| 542146 | 4/1956 | Italy | 135/20 M |
| 802489 | 10/1958 | United Kingdom | 135/22 |
| 1357870 | 6/1974 | United Kingdom | 135/20 M |

*Primary Examiner*—David A. Scherbel
*Assistant Examiner*—Lan Mai

[57] ABSTRACT

An automatic umbrella includes: a central shaft having an upper shaft telescopically mounted on a lower shaft, a rib assembly having at least a top rib and a stretcher rib supporting the top rib, an elongate extending spring inserted inside the central shaft which may be lightly operated for resetting the umbrella for restoring its elastic force for extending the shafts, the ribs and the umbrella, a plurality of restoring springs each secured in said rib assembly for normally urging and retracting the ribs, and a seesaw button seesawly formed in a grip of the shaft for selectively extending the shaft, the ribs for opening the umbrella, or for retracting the ribs for closing the umbrella.

9 Claims, 6 Drawing Sheets

211
15
16
539
21
2
41
23
32
537b
213
22
212
4
16
15
42
24
25
537
1
3
14
537a
538
141
535b
535
11
131
31
132
13
521
122
111
12
52
520
522
511
51
535a
523
510
532
5
123
512
536
53
121
120
531
533

23
21
211
21
2
23
539
42
42
32
537a
535b
538
24
24
4
4
213
213
41
41
212
212
537
22
22
1
3
14
537b
25
141
535
11
536
535a
11
131
31
132
13
521
111
52
122
520
522
12
511
523
51
534
510
532
5
123
512
121
53
120
531
D

LIGHTLY-OPERATING AUTOMATIC UMBRELLA FOR PREVENTING FALSE OPERATION

BACKGROUND OF THE INVENTION

A conventional automatically opening and closing umbrella, such as taught by U.S. Pat. No. 4,421,133 by Yueh Huang, U.S. Pat. Nos. 4,535,374 and 4,823,821 by San-Tong Day and U.S. Pat. No. 4,825,888 by Tseng Su, disclosed a short spring for opening the umbrella which is retained within an intermediate tubular shaft between an upper tubular shaft and a lower tubular shaft. Since the spring for opening the umbrella is so short between the upper and lower shafts, the spring must be made of larger or coarse steel wire to develop enough elastic force so that it requires a big force for depressing the umbrella grip for restoring the elastic force of the spring after being released, easily causing tiredness of an umbrella user or possibly causing loss of a user's interest.

Meanwhile, it is easy to falsely operate the conventional automatic umbrella, for instance, in depressing the push button 6 of Day's U.S. Pat. No. 4,823,821, a suddenly continuous depression of the button 6 or uncareful push button operation, the umbrella frame and cloth may be first opened and then closed quickly. A false operation may be done for such conventional automatic umbrella.

The present inventor has found the drawbacks of the conventional automatic opening and closing umbrellas and invented the present lightly-operating umbrella for preventing false operation.

SUMMARY OF THE INVENTION

The object of the present invention is to provide an automatic umbrella having an elongate extending spring stored within the hollow portions in all telescopic tubular shafts of the umbrella central shaft for a lighter depression work for saving a user's energy when restoring or resetting the extending spring ready for its next extending operation.

Another object of the present invention is to provide a control mechanism for preventing a false push button operation, such as for preventing an unwanted suddenly collapsing after opening an umbrella.

DETAILED DESCRIPTION

Figure 1:
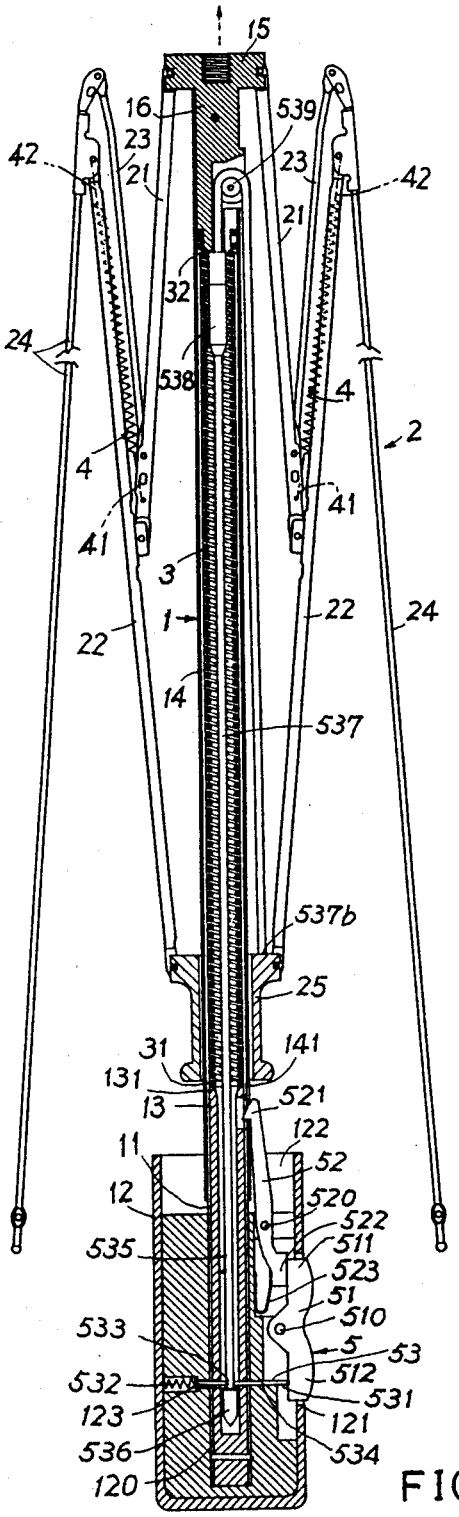
FIG. 1 is an illustration of the present invention when folded.
Figures 2, 3:
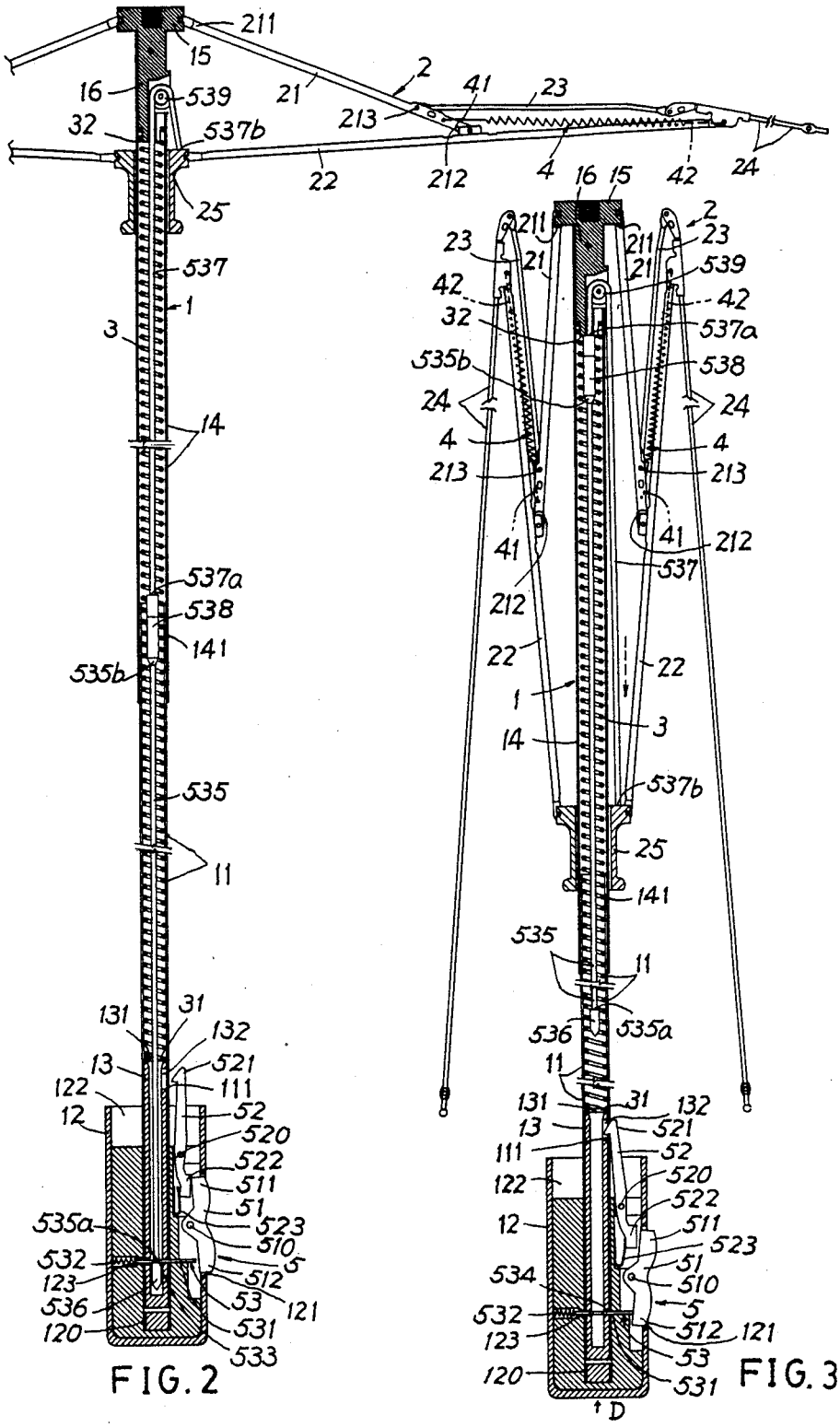
FIG. 2 shows an extending umbrella in accordance with the present invention.
FIG. 3 shows a collapsing umbrella of the present invention when retracting the umbrella as shown in FIG. 2.

As shown in FIGS. 1–3, the present invention comprises: a central shaft means 1, a rib assembly 2 for securing an umbrella cloth thereon, an extending spring 3 for opening the umbrella, at least a retraction restoring means 4 for closing the umbrella, and a control means 5 for the control of opening or closing operation of the umbrella.

The central shaft means 1 includes: a lower tubular shaft 11, a grip 12, a sleeve 13 fixed in the lower shaft 11, an upper tubular shaft 14 telescopically mounted on the lower shaft 11, and an upper notch 15 formed on a top portion of the upper shaft 14 having an inner block 16 fixed therein.

The lower tubular shaft 11 has its lower portion inserted in a central shaft hole 120 in the grip 12, having a hook hole 111 formed in a lower portion of the shaft 11 communicated with another hook hole 132 formed in an upper portion of the sleeve 13. The sleeve 13 includes an upper taper opening 131 for smoothly guiding a locking head 536 of the retraction controller 53 of the control means 5 into the sleeve 13.

The upper tubular shaft 14 is formed with a hook hole 141 in a lower portion of the shaft 14 communicated with the hook holes 111, 132 when shortening the shafts 1 and folding the umbrella as shown in FIG. 1. The connection between the upper shaft 14 and the lower shaft 11 is a conventional mechanism for preventing their separation.

The rib assembly 2 is conventional as found in a conventional umbrella and may include: a first top rib 21 having an inner end portion 211 of the rib 21 pivotally secured to the notch 15, a stretcher rib 22 having an inner end portion of the rib 22 pivotally secured to a runner 25 slidably encompassed on the upper tubular shaft 14 and having a middle portion of the rib 22 pivotally secured with an outermost end portion 212 of the first rib 21, a second top rib 23 having its inner end portion pivotally secured to a second outer end portion 213 of the first rib next to its outermost end portion 212, and a third top rib 24 respectively pivotally secured to two outermost end portions of both second top rib 23 and stretcher rib 22.

The extending spring 3 is an elongate coil spring having a diameter of each spring ring generally equal to an inside diameter of the lower shaft 11 having its lower end 31 retained on a top end of the sleeve 13 and having its upper end 32 retained against a bottom portion of the inner block 16 secured to the upper notch 15.

The retraction restoring means 4 may be a restoring coil spring having its inner end 41 secured to an outer portion 213 of the first top rib 21 and having its outer end 42 secured to an outer end portion of the stretcher rib 22. The spring 4 is normally urging the rib assembly 2 towards a collapsed state, such as for normally urging the stretcher rib 22 and runner 25 downwardly as shown in FIG. 3 so as to close the umbrella. The elastic force of the spring 4, when compressed by extending the rib assembly 2 when opening the umbrella as shown in FIG. 2, should always be smaller than the elastic force of the extending spring means 3 under compression when the umbrella is closed and the tubular shafts are shortened to accumulate the elastic force of the spring 3 as shown in FIG. 1.

The control means 5 includes: a seesaw button 51, an extension controller 52 for controlling the extension of upper shaft 14 and the opening of the umbrella, and a retraction controller 53 for the control of the retraction of the rib assembly 2 and the closing of the umbrella.

The seesaw button 51 is pivotally mounted by a pin 510 in a button hole 121 formed in a side portion of the grip 12, having an upper lever 511 operatively depressing the extension controller 52 and a lower lever 512 operatively depressing the retraction controller 53.

The extension controller 52 generally formed as a biasing lever has its middle portion pivotally secured in a socket 122 in the grip 12 above the button 51 by a pin 520, its upper portion formed as a hook portion 521 engageable with the hook holes 141, 111, 131 formed in the central shaft means 1, and its lower portion formed as a depression block 522 resiliently retained by an upper tensioning spring 523 secured in the grip 12 and operatively depressed by the upper lever 511 of the seesaw button 51. The tensioning spring 523 normally urges the lower depressing block 522 outwardly to bias the upper hook portion 521 inwardly to engage the hook holes 141, 111, 131 formed in the shafts 14, 11 and sleeve 13.

Figure 1A:
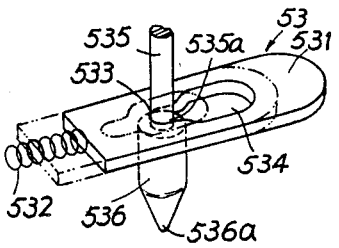
FIG. 1*a* shows a partial control means of the present invention.

The retraction controller 53 includes: a sliding latch 531 as shown in FIG. 1*a* transversely sliding in a lateral slot 123 formed in a lower portion of the grip 12 and resiliently held in the slot 123 by a lower tensioning spring 532 which urges the sliding latch 531 outwardly, having an inner latch hole 533 for passing therethrough a drag rod 535 and an outer latch hole 534 adjacent to the hole 533 larger than the inner hole 533 for passing a locking head 536 formed on a lower end portion 535*a* of the rod 535 through the outer hole 534; the drag rod 535 slidably held in the shaft means 1 having the lower locking head 536 having a diameter larger than that of the rod 535 with a taper portion 536*a* formed on its lowest end portion, and having an upper end portion 535*b* secured with a coupling 538; and a flexible rope 537 (or wire) trailed inside the shaft means 1 or outside a tubular wall of the upper shaft 14, having a lower end portion 537*a* secured to the coupling 538 to connect the drag rod 535, an outer end portion 537*b* secured to the runner 25 and a roller 539 pivotally mounted on the inner block 16 for slidably guiding the rope 537 thereon.

The drag rod 535 has a length slightly longer than a length of a shortened or folded shaft means 1 as shown in FIG. 1 having its lower locking head 536 normally locked by the sliding latch 531 and having its upper end portion 535*b* secured with the coupling 538 limited by the inner block 16 secured on the upper portion of the upper shaft 14.

The flexible rope 537 has a length generally equal to a length between the runner 25 when closing the umbrella and retracting the ribs 2 inwardly towards the shaft 1, and the inner block 16, against which block 16 the coupling 538 is retained as shown in FIG. 3. A total length of the length of the upper rope 537 plus the length of the lower rod 535 is generally equal to a length of an extended shaft means 1 as shown in FIG. 2.

When it is intended to open the folded umbrella as shown in FIG. 1, the upper lever 511 is depressed inwardly to bias the extension controller 52 to release the hook portion 521 from the hook hole 141 of the upper shaft 14 so that the extending spring 3 having stored its elastic force when folding the shafts from the situation as shown in FIG. 3 to FIG. 1 will urge the inner block 16 and the upper shaft 14 upwardly so as to extend the ribs 2 outwardly upwardly for opening the umbrella as shown in FIG. 2. The rope 537 and rod 535 having the locking head 536 locked by the latch 531 are linearly linked to counteract a retraction force urged by the restoring spring 4 for preventing a false closing of umbrella when extended as shown in FIG. 2. After releasing the elastic force of the spring 3 as shown in FIG. 2, the spring 3 may have an extended length almost equal to the length of the extended shaft means 1. The extended spring 3 should still have an elastic force acting upon the inner block 16 for ensuring a stable opening of the extended umbrella.

For closing the umbrella, the lower lever 512 is depressed inwardly to depress the latch 531 to allow the larger outer hole 534 to match the locking head 536 to unlock the locking head 536. Simultaneously, the restoring spring 4 normally urges the stretcher rib 22 and runner 25 downwardly to retract the rib assembly 2 towards the central shaft means 1 to pull the rope 537 outwardly through the roller 539 to raise the rod 535 upwardly until being limited by the block 16 since the rod 535 and locking head 536 is no longer locked by the latch 531, thereby closing the umbrella automatically as shown in FIG. 3. At this time, the spring 3 is still at released situation so that a resetting or restoring operation must be done by depressing the grip 12 in a direction D towards the upper notch 15 so as to shorten or fold the plural shafts and to restore the spring 3 for accumulating its resilience energy or elastic force for next opening or extension operation (FIG. 3 to FIG. 1).

The present invention has the following advantages superior to a conventional automatic closing and opening umbrella:

1. The extending spring 3 has a length releasably occupying a full length of the extended lower shaft 11 and upper shaft 14 so that it can be depressed for resetting the spring 3 from FIG. 3 to FIG. 1 with a lighter force, as compared with a conventional automatic umbrella having a very short restoring spring in view of Hooke's law.

2. Even depressing the lower lever 512 of the seesaw button 51 of the umbrella as shown in FIG. 1, the upper extension controller 52 is not operated so that the umbrella will not be falsely opened. Reviewing the extended umbrella as shown in FIG. 2, even the restoring spring 4 always urges the rib 22 to lower the runner 25 in order to close the umbrella, the downward pulling of rope 537 for retracting the ribs 2 is locked by the latch 531 which locks the locking head 536 of the rod 535 connected with the rope 537, unless depressing the lower lever 512 of button 51. So, at this time if a false depression of the upper lever 511, the umbrella is not influenced, without being falsely closed.

Accordingly, this invention may prevent a false operation. It means that an opening or a closing operation can be clearly distinguished by depressing either an upper lever or a lower lever of a seesaw button of the invention.

3. The automatic opening and closing mechanism and structure of this invention is very simple so that a production cost thereof can be greatly reduced, and a service life of the umbrella can be prolonged.

Figure 4:
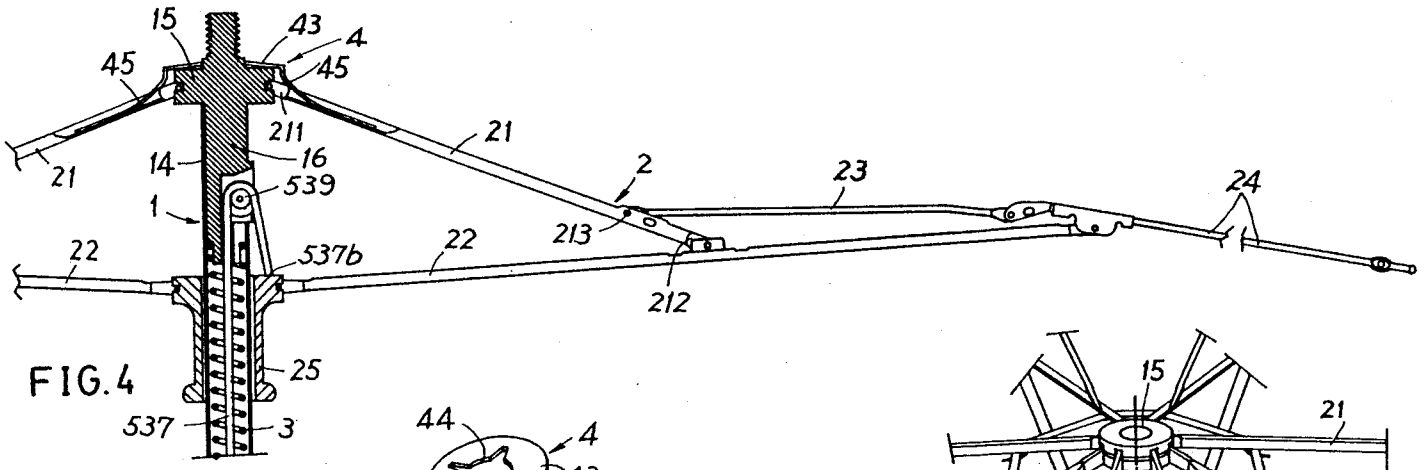
FIG. 4 shows another preferred embodiment of the present invention by using a retraction restoring means of tetrafurcate spring member.
Figure 5:
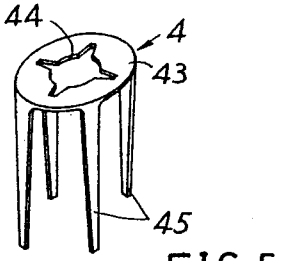
FIG. 5 shows the spring member as used in FIG. 4.

As shown in FIGS. 4, 5, the retraction restoring mechanism 4 of the present invention can be modified to be a tetrafurcate spring member 4 which includes a central disk 43 having a fixing hole 44 for securing the spring member on an upper notch 15 of the upper shaft 14, and four spring arms 45 each embedded in a first top rib 21. Such a tetrafurcate spring member always urges the rib assembly 2 downwardly in order to close the umbrella.

Figure 6:
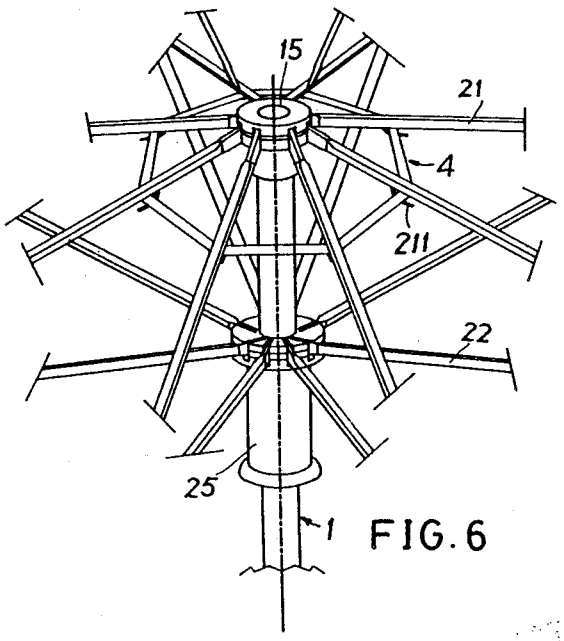
FIG. 6 shows another retraction restoring means for closing the umbrella of the present invention.

As shown in FIG. 6, the retraction restoring spring 4 of the present invention may be modified to be a fastening ring 4 having the ring secured on a plurality of brackets 211 formed on the first ribs 21, which ring 4 may always fasten or retract the ribs towards the central shaft 1 so as to close the umbrella. Such ring 4 may be a rubber, an elastomer, or a resilient member having suitable elasticity.

Figure 7:
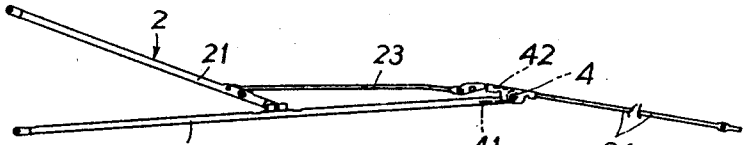
FIG. 7 shows still another retraction restoring means of the present invention.

As shown in FIG. 7, a small restoring spring 4 is secured at a pivotal point between the stretcher rib 22 and the third top rib 24, having one spring end 41 secured in the outer end portion of the stretcher rib 22 and having the other spring end 42 secured in the inner portion of the third rib 24, so as to always urge the ribs 2 downwardly for their retraction.

Figure 9:
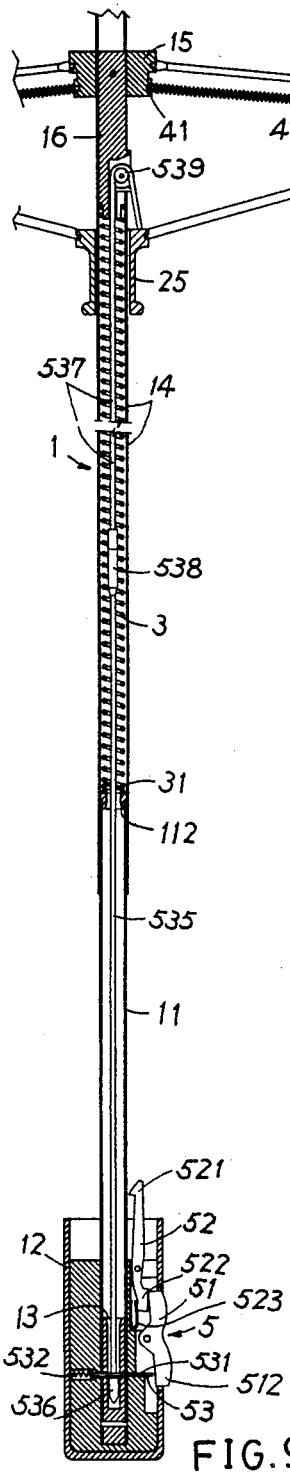
FIG. 9 shows an extended umbrella when opening the umbrella as shown in FIG. 1.
Figure 8:
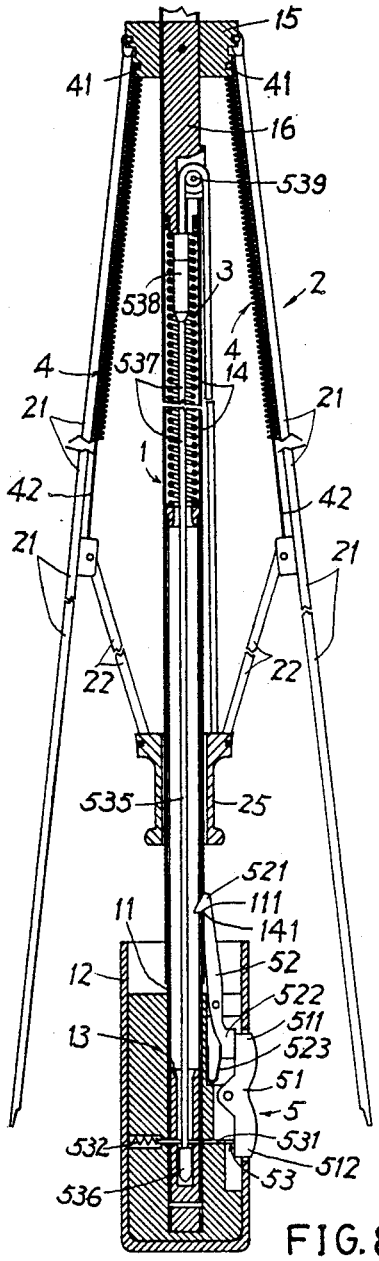
FIG. 8 shows further preferred embodiment of the present invention for a single fold umbrella as folded.
Figure 10:
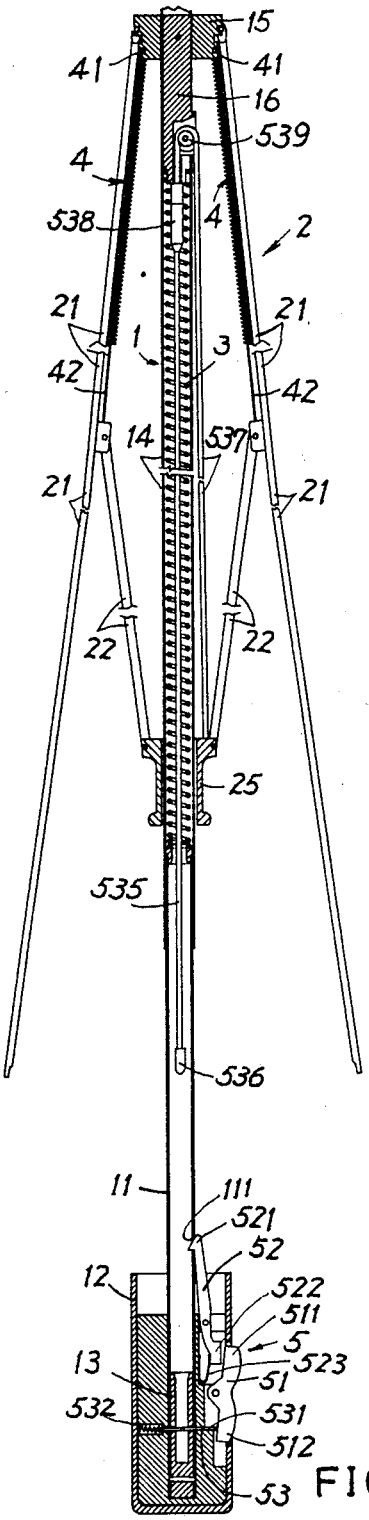
FIG. 10 shows a further step for shortening the shaft of the umbrella from that as shown in FIG. 9.

As shown in FIGS. 8, 9, 10, the present invention is used for a single-fold automatic umbrella, other than the double-fold umbrella as aforementioned. The extending spring 3 has its lower end 31 retained on a plug 112 fixed on a top end of the lower tubular shaft 11. The sleeve 13 is reduced for its length when fixed in the lower shaft 11. The retraction restoring means 4 is a restoring coil spring having an inner spring end 41 secured to the upper notch 15 and having an outer spring end 42 secured to a joint 221 pivotally connecting the top rib 21 and the stretcher rib 22 or secured to a middle portion of the top rib 21. The operating principles of the present invention as shown in FIGS. 8, 9, 10 are same as that shown in and respectively corresponding to FIGS. 1, 2, 3.

Figure 11:
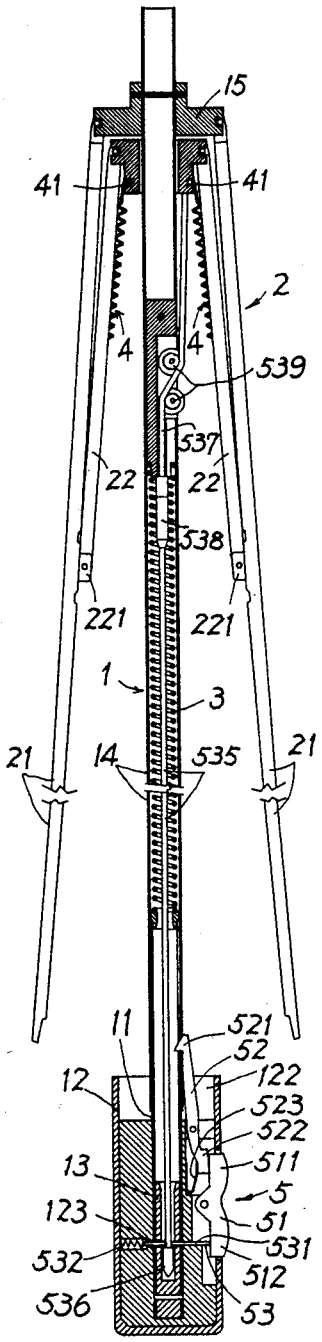
FIG. 11 shows still further preferred embodiment of the present invention when folded.
Figures 12, 13:
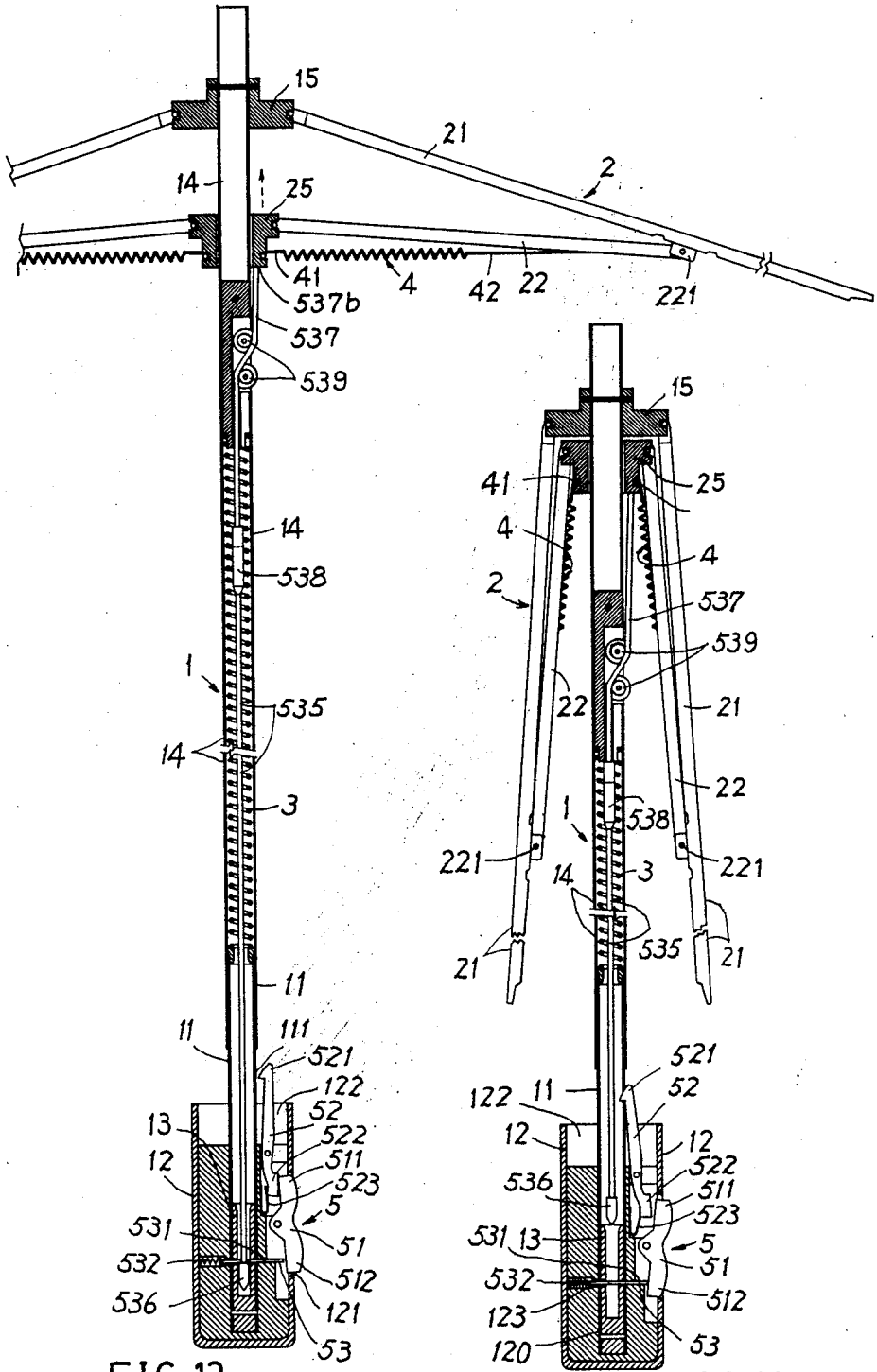
FIG. 12 shows an extended umbrella of the present invention when opening the umbrella as shown in FIG. 11.
FIG. 13 shows a collapsed umbrella when closing the umbrella as shown in FIG. 12.

As shown in FIGS. 11, 12 and 13, the present invention may be modified to provide a pair of rollers 539 to guide the flexible rope 537 of which the outer end portion **537*b* is secured to the runner 25. Upon a retraction of the ribs 2 as urged by the spring 4, the runner 25 is raised towards the upper notch 15 in order to close the umbrella. The restoring spring 4 has its inner end 41 secured to the runner 25 and has its outer end 42 secured to a joint 221 pivotally connecting the stretcher rib 22 and the top rib 21, or secured to an outer portion or a middle portion of the stretcher rib 22 to normally urge the ribs to their retraction state towards the central shaft means 1. The operating principles of FIGS. 11, 12, 13 are similar to that as shown in FIGS. 1, 2, 3 as aforementioned. However, the retraction of the ribs 2 causes an upward movement of the runner 25 along the upper shaft 14, which is different from a downward movement of runner 25 as shown in FIG. 3**.

The seesaw button 51 of the control means 5 may also be modified to include two buttons (not shown), an upper button for operatively depressing the extension controller 52, and a lower button for depressing the sliding latch 531 of the retraction controller 53.

I claim:

1. An automatic umbrella comprising:

a central shaft means including a lower tubular shaft, a grip fixed on a lower portion of said lower tubular shaft, a sleeve inserted in said lower shaft, an upper tubular shaft telescopically mounted on said lower tubular shaft, and an upper notch formed on an upper portion of said upper shaft;

a rib assembly for securing an umbrella cloth thereon including at least a top rib having an inner end portion of said top rib pivotally secured to said upper notch and a stretcher rib pivotally secured to at least one said top rib having an inner end portion of said stretcher rib pivotally secured to a runner slidably encompassed on said upper shaft;

an extending spring formed as an elongate coil spring retained in said central shaft means having a lower end of said extending spring retained on an upper end of said sleeve and having an upper end of said extending spring retained on an inner block secured to said upper notch inside said upper shaft, said extending spring having a length when releasing its elastic force upon an extension of said central shaft means generally equal to a length of an extended central shaft means;

at least a retraction restoring means secured in said rib assembly normally urging said rib assembly downwardly inwardly towards said central shaft means for closing the umbrella; and a control means formed in said grip selectively actuating an extension controller formed in an upper portion of said grip for extending said shaft means and said rib assembly for opening the umbrella, or actuating a retraction controller generally formed in a lower portion of said grip and inside said shaft means for closing the umbrella;

the improvement which comprises:

said extension controller generally formed as a biasing lever pivotally secured in a socket formed in an upper side portion of said grip, having a hook portion formed on an upper portion of said extension controller engageable with a hook hole formed in a lower portion of said upper shaft, and a depression block formed on a lower portion of said extension controller resiliently protruding outwardly by a tensioning spring in said grip to be depressible by said control means for biasing said hook portion inwardly to engage said hook hole in said upper shaft for locking said upper shaft for folding the shaft means and the umbrella; and said retraction controller including a sliding latch resiliently formed in a lower portion of said grip to be operatively depressed by said control means, a drag rod slidably held inside said shaft means having a locking head formed on a lower end portion of said drag rod normally locked by said sliding latch, and a flexible rope having an inner end portion of said rope connected to said drag rod and operatively trailed inside said shaft means or outside a tubular wall of said upper shaft as guided by at least a roller pivotally secured in said inner block of said upper notch, and having an outer end portion of said rope secured to said runner, said rod and said rope linearly linked with the locking head locked by said sliding latch to counteract a retraction force urged by said retraction restoring means for preventing a false closing operation of the umbrella when the rib assembly and shaft means are extended to open the umbrella.

2. An automatic umbrella according to claim 1, wherein said extension controller generally formed as a biasing lever pivotally secured in a socket formed in an upper side portion of said grip, a hook portion formed on an upper portion of said extension controller engageable with a hook hole formed in a lower portion of said upper shaft, and a depression block formed on a lower portion of said extension controller resiliently protruding outwardly by a tensioning spring in said grip to be depressible by said control means for biasing said hook portion inwardly to engage said hook hole in said upper shaft for locking said upper shaft for folding the shaft means and the umbrella.

3. An sutomatic Umbrella according to claim 1, wherein said hook portion of said extensioncontroller is engageable with a second hook hole formed in a lower portion of said lower shaft and a third hook hole formed in an upper portion of said sleeve inserted in a lower portion of said lower shaft.

4. An automatic umbrella according to claim 1, wherein said retraction controller includes a sliding latch resiliently formed in a lower portion of said grip to be operatively depressed by said control means, a drag rod slidably held inside said shaft means having a locking head formed on a lower end portion of said drag rod normally locked by said sliding latch, and a flexible rope having an inner end portion of said rope connected to said drag rod and operatively trailed inside said shaft means or outside a tubular wall of said upper shaft as guided by at least a roller pivotally secured in said inner block of said upper notch, and having an outer end portion of said rope secured to said runner, said rod and said rope linearly linked with the locking head locked by said sliding latch to counteract a retraction force urged by said retraction restoring means for preventing a false closing operation of the umbrella when the rib assembly and shaft means are extended to open the umbrella.

5. An automatic umbrella according to claim 1, wherein said drag rod has a length slightly longer than a length of said shaft means as folded, having the lower locking head normally locked by the sliding latch and having an upper end portion of said rod secured with a coupling connected with the rope and limited by the inner block secured on the upper portion of the upper shaft.

6. An automatic umbrella according to claim 1, wherein said flexible rope has a length generally equal to a length between the runner when closing the umbrella and retracting said rib assembly inwardly towards said shaft means and the inner block, the length of said rope plus the length of said rod being generally equal to a length of said shaft means as extended.

7. An automatic umbrella according to claim 1, wherein said sliding latch of said retraction controller is resiliently held in a lateral slot formed in a lower portion of said grip by a lower tensioning spring which urges said sliding latch outwardly to be depressed by said control means, said latch having an inner latch hole for passing said rod and locking said locking head of said rod and an outer latch hole adjacent to and larger than said inner hole for passing said locking head when depressing said latch inwardly.

8. An automatic umbrella according to claim 1, wherein said retraction restoring means is a tetrafurcate spring member secured on said upper notch having four spring arms each arm embedded in a front top rib of the rib assembly for normally retracting said rib assembly for closing the umbrella.

9. An automatic umbrella according to claim 1, wherein said retraction restoring means is a fastening ring secured on all first top ribs of said rib assembly pivotally secured to said notch, normally fastening all ribs of said rib assembly inwardly for retracting the same.

* * * * *